United States Patent [19]

Vetter

[11] Patent Number: 4,674,149

[45] Date of Patent: Jun. 23, 1987

[54] WINDOW HINGE WITH OFFSET SASH ARM

[75] Inventor: Gregory J. Vetter, Owatonna, Minn.

[73] Assignee: Truth Incorporated, Owatonna, Minn.

[21] Appl. No.: 812,761

[22] Filed: Dec. 23, 1985

[51] Int. Cl.[4] ..... E05D 11/08; E05D 15/32

[52] U.S. Cl. ..... 16/341; 16/364; 16/370; 49/394

[58] Field of Search ..... 16/341, 360, 364, 370; 49/394

[56] References Cited

U.S. PATENT DOCUMENTS

| | | | |
|---|---|---|---|
| 2,784,459 | 3/1957 | Anderberg et al. | 20/42 |
| 3,345,777 | 10/1967 | Anderberg et al. | 49/248 |

FOREIGN PATENT DOCUMENTS

| | | |
|---|---|---|
| 2047309A | 11/1980 | United Kingdom . |
| 2081803A | 2/1982 | United Kingdom . |
| 2081804A | 2/1982 | United Kingdom . |
| 2101199A | 1/1983 | United Kingdom . |
| 2127092A | 4/1984 | United Kingdom . |
| 2133074A | 7/1984 | United Kingdom . |
| 2133458A | 7/1984 | United Kingdom . |

OTHER PUBLICATIONS

Copy of pp. 20–21–catalogue of Truth Incorporated, published Jul. 1983.

*Primary Examiner*—Fred Silverberg

*Attorney, Agent, or Firm*—Wood, Dalton, Phillips, Mason & Rowe

[57] ABSTRACT

A window hinge for mounting a window sash for pivotal movement between open and closed positions including a track mountable to window frame and a sash arm mountable to a window sash. The sash arm is supported for movement relative to the track by a plurality of links, with pivotal connections to the sash arm and to either the track or a shoe movable along the track. A cam surface on the sash arm coacts with a cam member on the track to assure pull-in of the sash arm when the window hinge moves to window-closed position. The cam surface has an apex which is offset relative to the center line of the sash arm and a pivot connection of a link to the sash arm is similarly offset whereby an inside edge of the sash arm is caused to align with an inside edge of the track when the window hinge is in window-closed position.

4 Claims, 4 Drawing Figures

WINDOW HINGE WITH OFFSET SASH ARM

BACKGROUND OF THE INVENTION

This invention pertains to a window hinge for mounting a window sash for pivotal movement between open and closed positions and which utilizes a track mountable to a window frame and a sash arm mountable to a window sash. Pivoted links and associated structure mount the sash arm to the track and provide for movement of the window sash. The sash arm is positioned opposite the track when the window is closed with the inside edge of the sash arm aligning with the inside edge of the track to assure tight closing of the window.

A window hinge of the general type disclosed herein is well known in the art, with applicant's assignee having a commercially-available 6-bar hinge having a track mountable to a window frame, a sash arm mountable to the window sash, a shoe slidable on the track, and a series of links pivotally interconnecting the sash arm to the shoe and the track to enable pivotal movement of a window. Additionally, the track has an inverted V-shaped cam at an end thereof and the sash arm has a cam surface at an end thereof for coaction with the cam member to assure movement of the window hinge and the window sash to a fully-closed position. When the window is closed, the outside edge of the sash arm is aligned with the outside edge of the track.

Additionally, window hinges of the general type disclosed in this application are shown in the Anderberg et al U.S. Pat. Nos. 2,784,459 and 3,345,777. These patents disclose a track with a V-shaped cam member at one end mountable to a window frame and a sash arm mountable to a window sash, with the track movably mounting a shoe and a series of links pivotally connecting the sash arm to the track and shoe. The first-mentioned Anderberg et al patent shows and describes the coplanar relation of the various pivot connections between the window hinge components and the lateral offset of certain of the pivotal connections when a window is fully closed. This results in the outside edge of the sash arm being in alignment with the outside edge of the track member. As pointed out in the patent, this offsetting of certain pivot connections to either side of the median line of the track results in the ability to use identical supporting brackets or window hinges at each end of the window merely by shifting the bar 16 (sash arm) to either side of center to predetermine to which side of the track the bar and associated connecting members are to move.

There are certain applications which require that the window hinge have the sash arm inside edge aligned with the inside edge of the track to fully close the window and the invention disclosed herein achieves this result.

SUMMARY OF THE INVENTION

A primary feature of the invention is to provide a new and improved window hinge providing for a heretofore unknown alignment of a sash arm mountable to a window sash with a track mountable to a window frame to enable the desired association of the sash arm with the window sash and provide for tightly closing the window.

More particularly, the sash arm is pivotally associated with the track and a shoe movable along the track by pivotal connections to associated links and one of the pivotal connections to the sash arm is offset. A cam surface at an end of the sash arm is also offset for coaction with a cam member at an end of the track whereby coaction between the cam surface and the cam member as the window is closed draws the sash arm to a position where the sash arm is opposite the track and the inside edge of the sash arm is aligned with the inside edge of the track.

An object of the invention is to provide a window hinge for mounting a window sash for pivotal movement between open and closed positions, including a track mountable to a window frame and a sash arm mountable to a window sash, with interconnecting links pivotally connected thereto, a cam surface on an end of the sash arm positioned for coaction with a cam member on an end of the track and at least one pivot connection of a link to the sash arm being positioned to bring an inside edge of the sash arm into alignment with an inside edge of the track when the window is fully closed.

Still another object of the invention is to provide a window hinge for pivotally mounting a window sash relative to a window frame and having a track mountable on the window frame, a sash arm mountable on the window sash to be opposite the track when the window is closed, and means mounting the sash arm for movement relative to the track comprising, a first link having a first pivot connection at one end to the track and at the other end a second pivot connection to the sash arm intermediate the ends thereof, a shoe slidably mounted on the track, a second connecting link having pivot connections at its opposite ends to the shoe and said first link respectively, and a third link having a first pivot connection to the shoe and a second pivot connection to the sash arm adjacent an end thereof, an inverted V-shaped cam member at an end of the track having an apex in alignment with the center line of the track and a cam surface on an end of said sash arm which engages the cam member upon closing of the window to assure movement of the sash arm to a position for complete closing of the window, the improvement comprising: said cam surface terminating at an end which is offset from the center line of the sash arm toward the outer edge thereof; and the pivot connection of the third link to the sash arm being similarly offset whereby engagement of the cam surface and cam member with the window closed causes the sash arm to be offset in a direction to have an inside edge thereof overlie the inside edge of the track.

DESCRIPTION OF THE PREFERRED EMBODIMENT

The disclosed window hinge is usable for pivotally mounting a window sash relative to a window frame and can be used for mounting the sash of a casement window or the sash of a window where the sash projects either in or out relative to the window frame.

Figure 1:
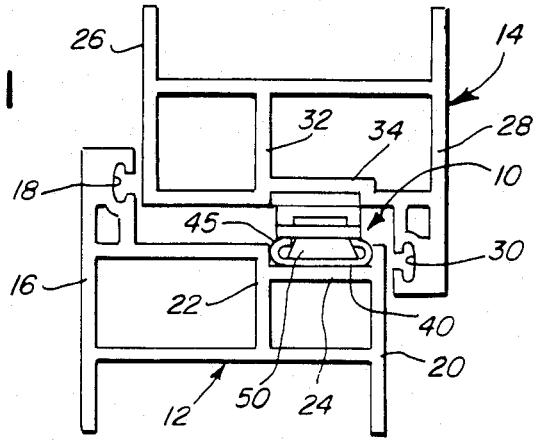
FIG. 1 is a fragmentary, transverse section of a window sash in closed relation with a window frame and with the window hinge associated therewith.

The window hinge is shown generally at 10 in FIG. 1 in association with a window frame, shown in cross section and indicated generally at 12, and a window sash, shown in cross section and indicated generally at 14. The window sash and window frame may be formed of a material other than wood, such as plastic or metal, and are shown as being of a type that can be formed in lengths, as by an extrusion process. The window frame 12 has an inner side defined by a wall 16 and at its upper end is shaped with a recess 18 to receive a weather stripping material (not shown). An outer wall 20 of the window frame coacts with an internal wall 22 and a transverse wall 24 to define a recess which receives a part of the window hinge 10.

The window sash 14 has an inner wall 26 which abuts against the weather stripping in the recess 18 of the wall 16 and an outer wall 28, shaped at its lower end to provide a recess 30 for receiving weather stripping (not shown) that will tightly engage the outer wall 20 of the window frame when the window is closed. An internal wall 32 of the window sash as well as a transverse wall 34 define a recess for receiving a part of the window hinge.

The window hinge has an elongate track 40 positioned in the elongate recess in the window frame 12, as seen in FIG. 1, and is provided with openings 41–43 to facilitate mounting thereof to the window frame by use of suitable fastening members extending therethrough. The track 40 has a cross-sectional shape, as seen particularly in FIG. 1, with upwardlyturned flanges 45 and 46 at the inside and outside edges, respectively thereof, which turn inwardly at their upper ends to coact with a shoe 50 movable along the track and having a shape to interfit with the walls 45 and 46 of the track in a manner well known in the art.

A sash arm 52 is fitted within the recess formed on the underside of the window sash 14 and is secured to the window sash by fastening means which can extend through openings 53 and 54 in the sash arm. The sash arm has an outside edge 55 and an inside edge 56 and with the window fully closed the inside edge 56 of the sash arm overlies the inside edge 45 of the track. With the recesses in the window frame and the window sash for mounting the track 40 and sash arm 55, respectively, related as seen in FIG. 1, it is necessary to have the inside edge 56 of the sash arm coact with the inside edge 45 of the track to assure tight closing of the window.

The sash arm 52 is mounted for movement relative to the track 40 by a series of pivoted links. A first link 60 has a first pivot connection at one end to the track 40, as provided by a rivet 61, and a second pivot connection at its other end to the sash arm 52 intermediate the ends thereof as provided by a rivet 62. A second connecting link 65 has a pivot connection at one end to the shoe 50 provided by a rivet 66. The other end of the second connecting link 65 is pivotally connected to the first link 60 intermediate its ends by a pivot connection defined by a rivet 67. A third link 70 has a first pivot connection to the shoe, as defined by a rivet 71, and a second pivot connection to the sash arm 52 adjacent an end thereof, as defined by a rivet 72.

The track member 40 has a cap 75 mechanically locked to an end thereof and which is shaped with an inverted V-shaped cam member 76 having an apex 77 aligned with the center line of the track 40. The cam member 76 coacts with an inverted V-shaped cam surface 80 having an apex 81 formed on an end of the sash arm 52 to function in a manner known in the art to pull in the end of the sash arm 52 as the window is closed.

Figure 2:
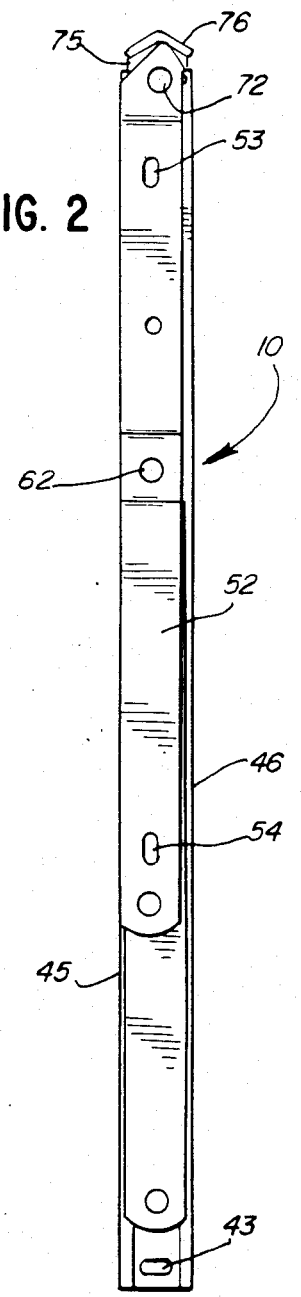
FIG. 2 is a plan view of the window hinge independent of the window and positioned in window-closed position.
Figure 3:
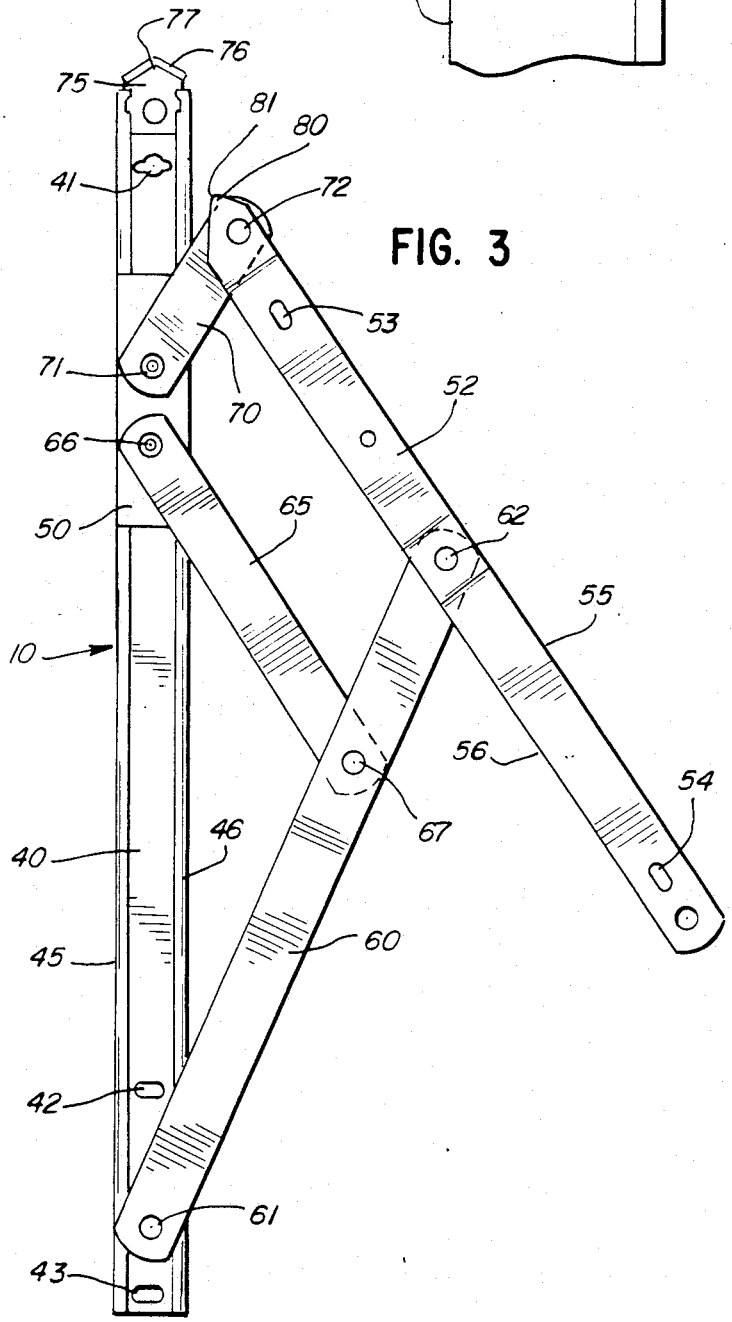
FIG. 3 is a view, similar to FIG. 2, showing the window hinge with the components in a partially-open window position.

With the window in partially-open position, the window hinge is shown as positioned in FIG. 3. As the window is closed, the window hinge moves to the final position shown in FIG. 2 and, prior to reaching the final position, the cam surface 80 will move into engagement with the cam member 76 to draw the upper end of the sash arm 52, as seen in FIG. 2, into the fully-closed position.

The sash arm 52, in the closed position of the window hinge, is caused to have its inside edge 56 aligned with the inside edge 45 of the track 40 by having the pivot connection of the third link 70 to the sash arm 52, as defined by the rivet 72, offset from the center line of the track 40 in the direction of the outside edge 46 of the track when the window is closed and by similar offset of the apex 81 of the cam surface 80.

Figure 4:
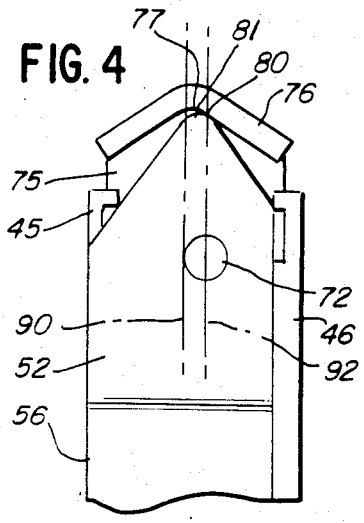
FIG. 4 is a fragmentary, enlarged view of the structure shown at the upper end of FIG. 2.

Referring more particularly to FIG. 4, a broken line 90 extends generally through the apex 77 of the cam member 76 and also represents a line extending along the center line of the track 40. The pivot connection of the first link 60 to the track 40 as well as the pivot connections to the shoe 50 extend generally along this line when the window hinge is in window-closed position. However, the pivot connection defined by rivet 72 is outwardly offset from this center line with the center thereof being indicated by a broken line 92 and the apex 81 of the cam surface 80 is similarly offset whereby the sash arm 52 has its inside edge 56 aligned with the inside edge 45 of the track. The apex 81 of the cam surface 80 and the pivot connection defined by the rivet 72 are aligned and offset relative to the center line of the sash arm 52 to achieve the desired alignment of the sash arm with the track 40 when the window is closed.

The offsetting of the pivot connection to the sash arm and the apex of the cam surface thereof provide for use of the window hinge with a window sash and window frame constructed to preclude use of the previously-known window hinge wherein an outside edge of a sash arm would align with an outside edge of a track of the hinge in window-closed position.

I claim:

1. A window hinge for mounting a window sash for pivotal movement between open and closed positions including a track mountable to a window frame, a sash arm mountable to a window sash and with said sash arm opposite said track when the window is closed, said sash arm having an inverted generally V-shaped cam surface at one end with an apex offset from the sash arm center line, a movable shoe on said track, a cam member at an end of the track, and a plurality of links pivotally interconnecting said track, shoe and sash, the improvement comprising: an offset pivot connection between one of said links and said sash arm offset from the sash arm center line toward the outside edge of the sash arm to have the inside edge of the sash arm align with the inside edge of the track when the cam member and cam surface are in engagement with the window closed.

2. A window hinge as defined in claim 1 where said cam member has an inverted V-shape with an apex aligned with the outer line of the track.

3. A window hinge for movably mounting a window sash relative to a window frame comprising, a track mountable on the window frame, a sash arm mountable on the window sash to be opposite the track when the window is closed, means mounting the sash arm for movement relative to the track comprising, a first link having a first pivot connection at one end to the track and at the other end a second pivot connection to the sash arm intermediate the ends thereof, a shoe slidably mounted on the track, a second connecting link having pivot connectios at its opposite ends to the shoe and said first link respectively, and a third link having a first pivot connection to the shoe and a second pivot connection to the sash arm adjacent an end thereof, a cam member at an end of the track, a cam surface on an end of said sash arm which is shaped to have an apex which engages the cam member upon closing of the window to assure movement of said sash arm end to a position for complete closing of the window, and both the second pivot connection of the third link to the sash arm and said apex being offset toward an outside edge of the sash arm whereby a line connecting said apex and the second pivot connection of the third link is offset from and substantially parallel to the center line of the track in a direction to have an inside edge thereof overlie the inside edge of the track when the window is closed and the cam surface apex is in engagement with the cam.

4. A window hinge for pivotally mounting a window sash relative to a window frame and having a track mountable on the window frame, a sash arm mountable on the window sash to be opposite the track when the window is closed, means mounting the sash arm for movement relative to the track comprising, a first link having a first pivot connection at one end to the track and at the other end a second pivot connection to the sash arm intermediate the ends thereof, a shoe slidably mounted on the track, a second connecting link having pivot connections at its opposite ends to the shoe and said first link respectively, and a third link having a first pivot connection to the shoe and a second pivot connection to the sash arm adjacent an end thereof, an inverted V-shaped cam member at an end of the track having an apex in alignment with the center line of the track, and an inverted V-shaped cam surface on an end of said sash arm which engages the cam member upon closing of the window to assure movement of the sash arm to a position for complete closing of the window, the improvement comprising: said cam surface terminating at an apex which is offset from the center line of the sash arm toward the outer edge thereof; and the second pivot connection of the third link to the sash arm being similarly offset and in substantial alignment with said cam surface apex wherein a line connecting the cam surface apex with the second pivot connection of the third link is offset from and substantially parallel to the center line of the track whereby engagement of the cam surface and cam member with the window closed causes the sash arm to be offset in a direction to have an inside edge thereof overlie the inside edge of the track.

* * * * *